US007540372B2

(12) United States Patent
Kepple

(10) Patent No.: US 7,540,372 B2
(45) Date of Patent: Jun. 2, 2009

(54) BELT DRIVEN AND ROLLER ASSISTED MEDIA TRANSPORT

(75) Inventor: Todd Kepple, Litchfield, NH (US)

(73) Assignee: ECRM, Inc., Tewksbury, MA (US)

( * ) Notice: Subject to any disclaimer, the term of this patent is extended or adjusted under 35 U.S.C. 154(b) by 78 days.

(21) Appl. No.: 11/325,909

(22) Filed: Jan. 5, 2006

(65) Prior Publication Data

US 2007/0151828 A1 Jul. 5, 2007

(51) Int. Cl.
*B65G 13/10* (2006.01)
*B65G 13/00* (2006.01)

(52) U.S. Cl. ..... 198/779; 198/781.03; 198/783; 198/780; 198/782; 198/349; 198/437; 198/457.02; 198/572

(58) Field of Classification Search ..... 198/779, 198/781.03, 783, 780, 782, 788, 781.3, 750
See application file for complete search history.

(56) References Cited

U.S. PATENT DOCUMENTS 1,763,883 A * 6/1930 Colvin et al. ..... 198/790
2,682,208 A 6/1954 Monroe
3,117,333 A 1/1964 Murray
3,410,183 A 11/1968 Sarka
3,679,043 A * 7/1972 Becker ..... 198/349
3,935,941 A 2/1976 Keck
3,938,674 A 2/1976 Kroeze
4,241,910 A 12/1980 Matsuo
4,666,140 A 5/1987 Godlewski
4,773,638 A 9/1988 Koutoudis
4,802,567 A * 2/1989 Ikeda et al. ..... 198/345.1
4,805,890 A 2/1989 Martin
4,835,574 A 5/1989 Ohi
4,930,765 A 6/1990 Russel
5,054,760 A 10/1991 Reist
5,087,026 A 2/1992 Wyer
5,122,030 A * 6/1992 Schmeisser et al. ..... 414/790.2
5,215,182 A 6/1993 Garbagnati
5,277,297 A 1/1994 Tolson
5,465,955 A 11/1995 Krupica
5,529,081 A 6/1996 Kappler (Continued)

OTHER PUBLICATIONS

AGFA, LP82 Ultra Lithostar Plate Processor Brochure (3 pages).

(Continued)

*Primary Examiner*—Gene Crawford
*Assistant Examiner*—Kavel P Singh
(74) *Attorney, Agent, or Firm*—Howard J. Greenwald P.C.

(57) ABSTRACT

Disclosed in this specification is a media transportation apparatus that is comprised a conveying and supporting sections. The conveying section is comprised of a motor and a first timing belt, wherein operation of the motor causes the first timing belt to travel in a first direction. The supporting section is comprised of rollers configured to roll in the same first direction. The first timing belt has a belt surface and the rollers have a rolling surface, such that the belt surface and the rolling surface are substantially coplanar with respect to one another. The apparatus receives media of any size from an imager that is operating at a first speed, transport the media with a transporter operating at a second speed, and deliver the media to a processor operating at a third speed. The first speed, second speed, and third speed, need not be the same speed.

16 Claims, 9 Drawing Sheets

U.S. PATENT DOCUMENTS

| | | | | |
|---|---|---|---|---|
| 5,599,246 | A | 2/1997 | Fujiwara | |
| 5,609,335 | A | 3/1997 | Parker | |
| 5,669,604 | A | 9/1997 | Hansen | |
| 5,685,539 | A | 11/1997 | Janatka | |
| 5,692,745 | A | 12/1997 | Neifert | |
| 5,738,014 | A | 4/1998 | Rombult | |
| 5,915,686 | A | 6/1999 | Neifert | |
| 5,954,473 | A | 9/1999 | Folsom | |
| 5,992,324 | A | 11/1999 | Rombult | |
| 6,164,435 | A | 12/2000 | Coen et al. | |
| 6,196,375 | B1 | 3/2001 | Cozza | |
| 6,422,801 | B1 * | 7/2002 | Solomon | 414/416.07 |
| 6,457,413 | B1 | 10/2002 | Loccufier | |
| 6,523,472 | B1 | 2/2003 | Loccufier | |
| 6,523,473 | B2 | 2/2003 | Loccufier | |
| 6,526,886 | B2 | 3/2003 | Loccufier | |
| 6,571,937 | B1 * | 6/2003 | Costanzo et al. | 198/779 |
| 6,575,457 | B2 | 6/2003 | Bakoledis | |
| 6,662,723 | B2 | 12/2003 | Loccufier | |
| 6,684,783 | B2 | 2/2004 | Salvestro | |
| 6,926,633 | B2 | 8/2005 | Di Cesare | |
| 7,040,478 | B2 * | 5/2006 | Ehlert | 198/370.09 |
| 2002/0108842 | A1 * | 8/2002 | Bonora et al. | 198/836.1 |
| 2002/0153225 | A1 * | 10/2002 | Wood et al. | 198/370.09 |

OTHER PUBLICATIONS

Colenta, ILP 68 Brochure (1 page).
Glunz & Jensen, InterPlater 85HD/135HD Brochure (2 pages).
Glunz & Jensen, Raptor 68/65 Brochure (2 pages).

* cited by examiner

FIG. 2A
FIG. 2C
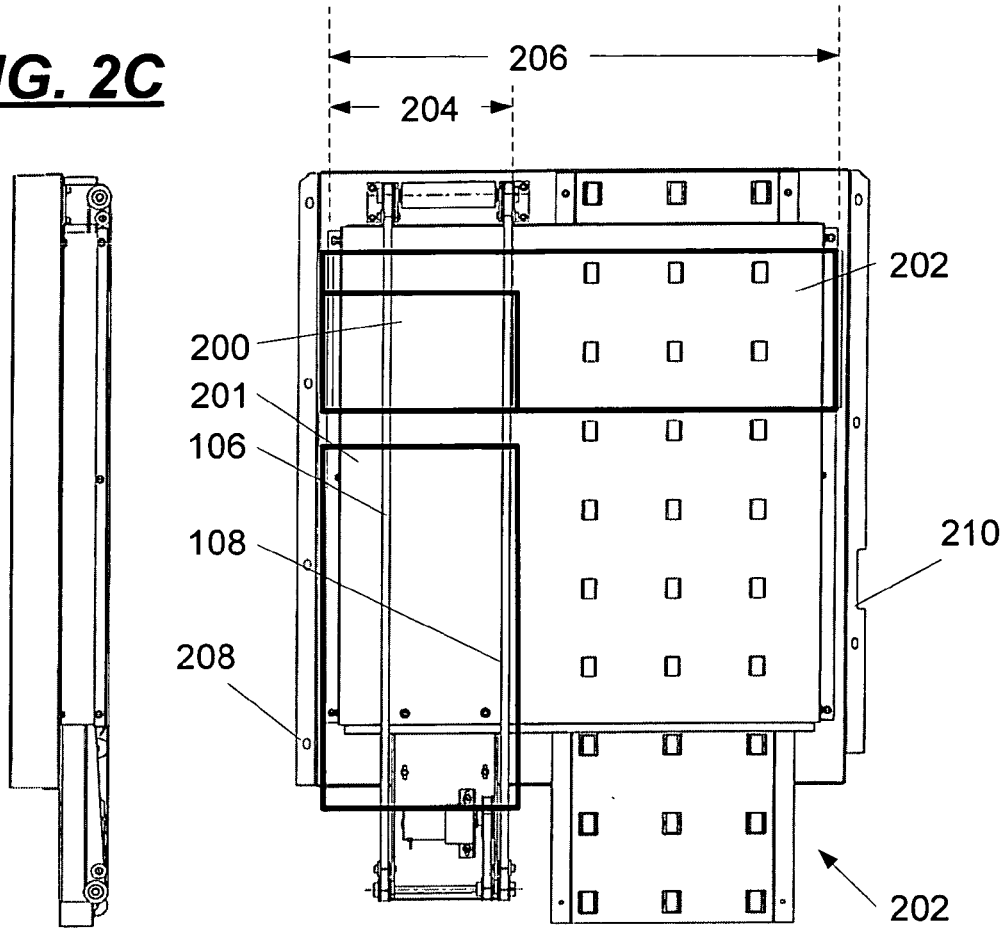
FIG. 2B
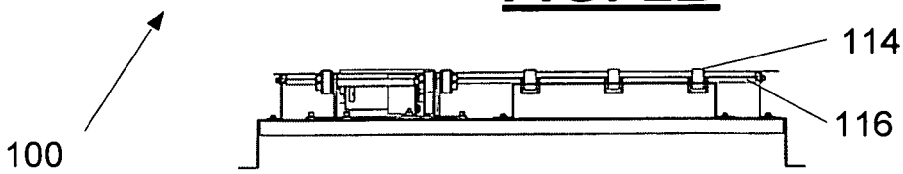
FIG. 2

BELT DRIVEN AND ROLLER ASSISTED MEDIA TRANSPORT

FIELD OF THE INVENTION

This invention relates to, in one embodiment, a conveying apparatus comprised of a conveying section and a supporting section designed to transport printing plates or other media from a first location to a second location. The apparatus is adapted to transport media regardless of the size of the media. Additionally, the apparatus is configured to receive a media from an imaging device that is operating at a first speed, transport the media with a transporter operating at a second speed, and deliver the media to a processor operating at a third speed. The first speed, second speed, and third speed, need not be the same speed.

BACKGROUND OF THE INVENTION

The present invention relates generally to a media transportation apparatus for moving printing media from a first location to a second location. The media transportation apparatus of the present invention permits media of various sizes to be moved without the need for expensive and costly equipment.

Current printing technology utilizes a variety of printing methodologies and assemblies. One such printing system is the so-called "Computer-to-Plate" (CTP) system. Reference may be had to U.S. Pat. No. 6,684,783 to Salvestro (Method for imaging a media sleeve on a computer-to-plate imaging machine); U.S. Pat. Nos. 6,662,723; 6,526,886; 6,523,473; 6,523,472; 6,457,413; all to Loccufier (Computer-to-plate by ink jet); U.S. Pat. Nos. 5,992,324 and 5,738,014; both to Rombult (Method and apparatus for making lithographic printing plates in an automated computer to plate imaging system); and the like. The content of each of the aforementioned patents is hereby incorporated by reference into this specification.

A Computer-to-Plate (CTP) system uses a CTP device to imprint a digital image onto a plate. This plate (i.e. media) is conveyed by a transportation apparatus from the CTP device to a processing device. The processing device develops the plate in preparation for printing.

Existing transportation apparatuses suffer from a number of limitations. Prior art transportation devices cannot easily accommodate plates of various sizes. Existing transporters are also prone to jamming. Generally, there are five types of transportation devices: Single wide belt transporters, Plurality of thin belt devices; Gravity rolling devices; Gripping devices, and Switchable devices.

Single wide belt transporters use a single wide conveyor belt to move the printing media (i.e. plate) from the CTP device to the processor device. Such devices are limited by the width of the belt itself. The transporter is unable to accommodate plates that are wider than the belt. Attempts have been made to use extremely wide belts, but such attempts have caused additional problems. Wider belts are difficult to control and thus require additional controlling mechanisms that add to the equipment costs of such assemblies. For example, additional mechanisms are often needed to ensure the belt properly tracks. Wider belts also require higher tension to prevent such a belt from slipping. These high tension belts, in turn, necessitate the use of costly, high torque motors. This higher tension necessitates the use of a more powerful and more expensive motor to drive the wide belt. Wider belts also increase the frictional force that is applied to the printing plate. This additional frictional force often prematurely pulls the plate from the CTP device before the image can be properly transferred to the plate. Such improper handling results in unacceptable image defects in the plate. Additionally, reconfiguration of the device for use with wider plates is difficult—such a reconfiguration requires replacing a substantial amount of the equipment.

Some transporter devices use a plurality of thin belt devices in an attempt to address the issues caused by the single wide belt transporters. However, such a thin belt design gives rise to other problems. The use of multiple thin belts leaves gaps between the belts. If a plate should have a width such that it falls within such a gap, the plates have been known to become lodged between the belt and the pulley that drives the belt, thus producing a jam. It would therefore be advantageous to provide a device that ensures the end of a plate will not rest in such a gap. Additionally, the more belts that are used, the more difficult it becomes to service such belts.

Gravity rolling transporters use inclined rollers to transport a plate from the CTP device to the processing device. However, the speed a plate travels down the incline is difficult to control and depends upon the weight, and thus the size, of the plate. Larger plates travel down the incline substantially faster than smaller (lighter) plates. Some degree of control can be achieved by altering the angle of the incline, however, such control is minimal. The small plates typically require a very steep angle to be properly transported, thus producing a rapid decent. During such a rapid decent, the plate may not fall to the processing device properly. In such an event, user intervention is required to rectify the situation.

Gripping transporter devices engage a plate at a first location, transport the plate to a second location, and thereafter disengage from the plate. One such gripping transporter is disclosed in U.S. Pat. No. 5,465,955 to Krupica (Method and Apparatus for an External Media Buffer), the content of which is hereby incorporated by reference into this specification. The operating speed of such gripping transports must exactly match the speed of the CTP device to which they are attached, or the media may not be properly transported. Moreover, the complexity of such gripping transporters causes them to have low reliability and increased equipment costs relative to other transporters.

Switchable transporter devices have attempted to address these shortcomings, but none of these devices has proven entirely satisfactory. Switchable devices are reconfigured by the user to permit the transporter to accept a media at a first speed, transport the media at a second speed, and deliver the media at a third speed. Such devices are rather complex, and this complexity often results in processing complications and low reliability. Additionally, such devices require user intervention to reconfigure the device for different speeds. The complex nature of the switchable transporter also results in higher equipment costs. One example of a switchable transporter is disclosed in U.S. Pat. No. 4,835,574 to Ohi (Automatic Photosensitive Material Conveying Apparatus), the contents of which are incorporated by reference into this specification.

The prior art considered of some importance to this application includes U.S. Pat. No. 2,682,208 to Monroe (Carton Converting Machine); U.S. Pat. No. 3,117,333 to Murray (Aperture Card Cleaner); U.S. Pat. No. 3,410,183 to Sarka (Material Processing Method and Apparatus); U.S. Pat. No. 3,935,941 to Keck (Adjustable belt conveyor); U.S. Pat. No. 3,938,674 to Kroeze (Method and apparatus for stacking paperboard blanks); U.S. Pat. No. 4,241,910 to Matsuo (Sheet delivering apparatus); U.S. Pat. No. 4,666,140 to Godlewski (Self-contained serially arranged plural section conveyor); U.S. Pat. No. 4,773,638 to Koutoudis (Deposit drawer for a document processing equipment for the deposit of documents having different sizes); U.S. Pat. No. 4,805,890 to Martin (Sheet stacking machine); U.S. Pat. No. 4,835,574 to Ohi (Automatic photosensitive material conveying apparatus); U.S. Pat. No. 4,930,765 to Russel (Sheet collection mechanism for stacking long and short sheets); U.S. Pat. No. 5,054,760 to Reist (Apparatus for conveying flat products); U.S. Pat. No. 5,087,026 to Wyer (Sheet conveying apparatus for conveying variable length sheets to a stack having a selectively positionable transport roller); U.S. Pat. No. 5,277,297 to Tolson (Controllable length conveyor); U.S. Pat. No. 5,465,955 to Krupica (Method and apparatus for an external media buffer); U.S. Pat. No. 5,529,081 to Kappler (Apparatus for the treatment of board-like articles); U.S. Pat. No. 5,609,335 to Parker (High capacity stacker/separating device); U.S. Pat. No. 5,669,604 to Hansen (System for accelerating and transferring imbricated printed products to a gripping chain); U.S. Pat. No. 5,685,539 to Janatka (Disk transport for paper sheets); U.S. Pat. No. 5,692,745 to Neifert (Belt-driven document accumulator having belt-dampening table and side guides); U.S. Pat. No. 5,915,686 to Neifert (Document accumulator having rotating assemblies for ramp adjustment); U.S. Pat. No. 5,954,473 to Folsom (Readily adjustable cut sheet stacker); and U.S. Pat. No. 6,575,457 to Bakoledis (Variable length sheet feeding mechanism). The content of each of the aforementioned patents is hereby incorporated by reference into this specification.

It is an object of this invention to provide a media transportation apparatus capable of transporting media of various sizes that is an improvement over the prior art devices.

It is an object of this invention to provide an uncomplicated, inexpensive media transportation apparatus capable of receiving a media at a first speed, transporting the media at a second speed, and delivering the media at a third speed, wherein the first, second and third speed are not necessarily synchronized.

SUMMARY OF THE INVENTION

In accordance with the present invention, there is provided a media transportation apparatus that is comprised of a conveying section and a supporting section. The conveying section is comprised of a motor and a first timing belt, wherein operation of the motor causes the first timing belt to travel in a first direction at a belt speed. The supporting section is comprised of rollers configured to roll in the same first direction. The first timing belt has a belt surface and the rollers have a rolling surface, such that the belt surface and the rolling surface are substantially coplanar with respect to one another. In some embodiments of the present invent, a second timing belt is present.

The invention is capable of transporting media, irregardless of the size of the media. Additionally, the apparatus is configured to receive a media from an imaging device that is operating at a first speed, transport the media with a transporter operating at a second speed, and deliver the media to a processor operating at a third speed. The first speed, second speed, and third speed, need not be the same speed.

The techniques described herein are advantageous because they are simple and inexpensive compared to prior art approaches. Additionally, the techniques taught herein are more flexible than prior art techniques and can easily be adapted to any number of printing plate sizes without the need for complex machinery.

BRIEF DESCRIPTION OF THE DRAWINGS

The invention will be described by reference to the following drawings, in which like numerals refer to like elements, and in which:

FIG. 2, which includes FIG. 2A, FIG. 2B, and FIG. 2C, is a top view, a end view, and a side view, respectively, of the transportation apparatus of FIG. 1;

Figure 1:
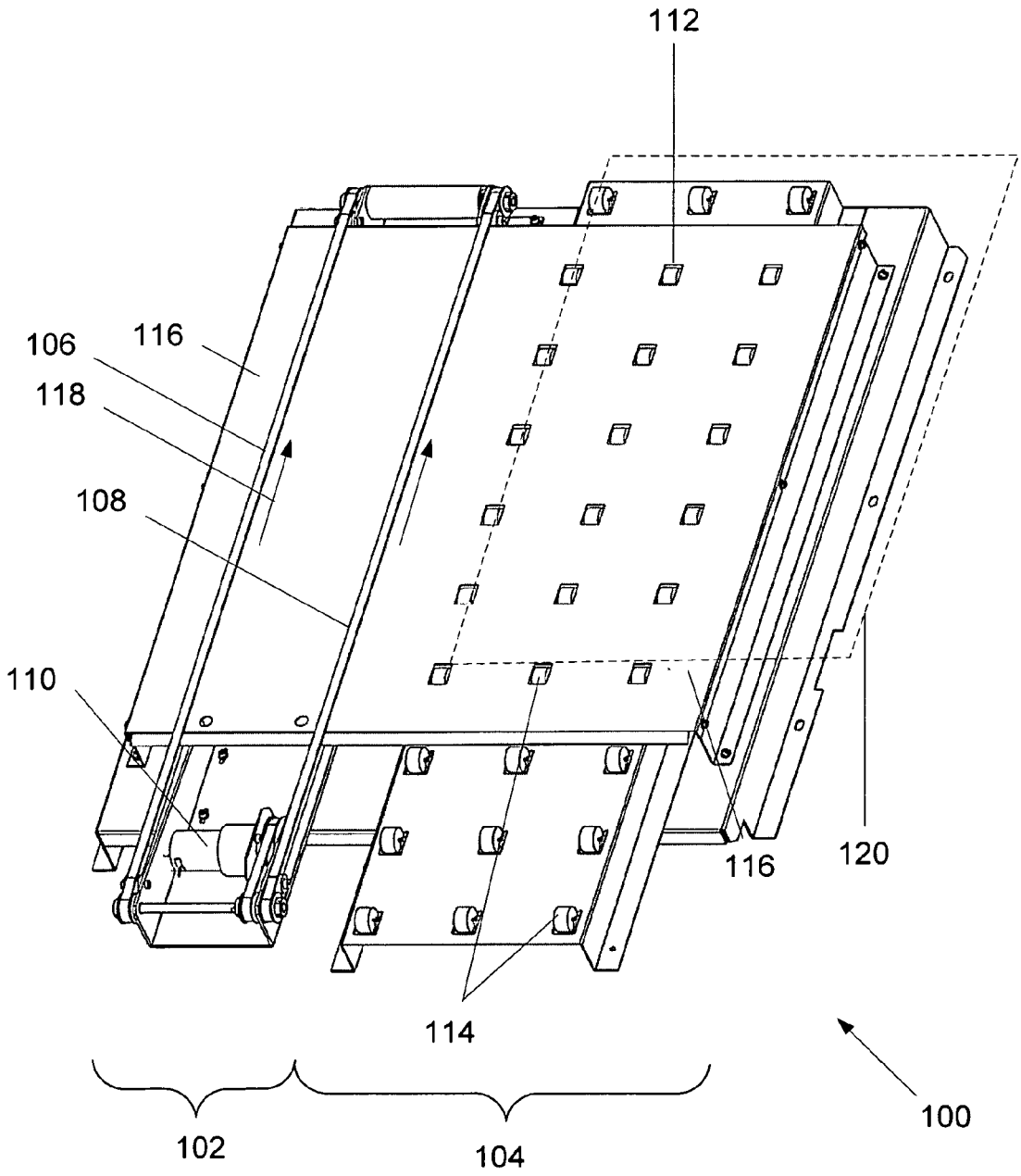
FIG. 1 is a perspective view of one transportation apparatus of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

Referring now to FIG. 1 and to the embodiment depicted therein, transporter 100 is comprised of a conveying section 102 and a supporting section 104. Conveying section 102 is comprised of first timing belt 106, second timing belt 108, and motor 110. Operation of motor 110 causes the first timing belt 106 to travel in a first direction 118 at a belt speed. Each of timing belts 106 and 108 have a belt surface that is substantially coplanar with respect to plane 120. First timing belt 106 and second timing belt 108 are substantially parallel with respect to one another. In one embodiment, timing belts 106 and 108 have a width of from about 0.25 centimeter to about 15 centimeters. In another embodiment, the width is from about 0.5 to centimeter to about 10 centimeters. In yet another embodiment, the width is from about 0.90 centimeter to about 1 centimeter. It is clear from FIG. 1 that any media, for example a printing plate, that was placed on first and second timing belts 106 and 108 would travel in direction 118 and thus be transported across transporter 100. In this specification, the media discussed is a printing plate. For example, one may use polyester or aluminum printing plates. However, as would be apparent to one of ordinary skill in the art, a wide variety of media can be used and such alternative media are considered within the scope of the present invention. In some situations, the user may wish to use media that is substantially wider than the distance between first and second belts 106 and 108. In such a situation, supporting section 104 provides additional support for such oversized media.

In the embodiment depicted in FIG. 1, transporter 100 is comprised of cover 116. The supporting section 104 is comprised of rollers 114 that protrude through orifices 112 in the cover 116. The rolling surface of rollers 114 protrude above the top surface of cover 116 by a distance of at least about 1 millimeter (see, for example, FIG. 2B) such that any media placed upon supporting section 104 comes in contact with the rolling surface of rollers 114 and contact with cover 116 is minimized or prevented. In another embodiment, the rollers 114 protrude above cover 116 by a distance of at least about 3 millimeters. The rolling surface of rollers 114 contact plane 120. It is advantageous to use rollers with a low coefficient of friction. For example, and in one embodiment, rollers 114 are nylon rollers. Rollers 114 lend support to oversized media which rests upon roller 114, thus promoting its transport in direction 118. Rollers 114 are configured to roll the media in direction 118 which is substantially parallel to the direction of travel of timing belts 106 and 108. In the embodiment depicted, rollers 114 function to support the media while it travels in direction 118 and do not actively push the media in such a direction. In another embodiment, rollers 114 are driving rollers and actively push the media.

In one embodiment of the present invention, timing belts 106 and 108 are toothed timing belts. Such toothed belts are known to those skilled in the art. Reference may be had to U.S. Pat. No. 5,599,246 to Fujiwara (Toothed Belt); U.S. Pat. No. 6,926,633 to Di Cesare (Toothed Belt); and the like. The content of each of the aforementioned patents is hereby incorporated by reference into this specification. In one embodiment of the invention, the teeth of the toothed belt are disposed on a toothed surface of the belt and the opposing side of the belt is a non-toothed surface. The toothed surface is contiguous with cover 116 such that motor 110 contacts the toothed surface. In this manner, the motor engages the toothed surface and drives the timing belt(s). Such a toothed configuration reduces the belt tension, thus allowing the use of low torque motors, while still permitting translation of the belt. The weight of the media on the non-toothed surface of the timing belts 106 and 108 causes the timing belt to become depressed, and thereby rest on the top surface of cover 116. Cover 116, therefore, functions to support the media and ensures the media remains parallel to plane 120.

FIG. 2 illustrates three views of transporter 100 of FIG. 1. FIG. 2A shows a top view, FIG. 2B depicts an end view, and FIG. 2C illustrates a side of transporter 100. As shown in FIG. 2A, transporter 100 is configured to receive media of various sizes. Small media 200 is disposed on transporter 100 such that it contacts both first and second timing belts 106 and 108 (see FIG. 1). In the embodiment illustrated in FIG. 2, the conveying section 102 (see FIG. 1) is disposed on a first side 208 of transporter 100 (see FIG. 1). Likewise, supporting section 104 (see FIG. 1) is disposed on a second side 210 of transporter 100. In the embodiment depicted in FIG. 2, the transporter is a left justified transporter. In such a transporter, the conveying section is disposed on the left side of the transporter (i.e. on first side 208). In another embodiment, not shown, the transporter is a right justified transporter and the conveying section and supporting section are juxtaposed. In yet another embodiment, the transporter is a centered transporter and the conveying section is disposed between two separate supporting sections.

It is preferable that the small media 200 have a width greater than the belt distance between the two timing belts 108 and 106. In one embodiment, the media, such as larger media 202, has a width that is substantially greater than smaller width 204. If media with a width substantially greater than smaller width 204 is used, such larger media 202 will come into contact with rollers 114, and be supported by such rollers. In one embodiment, the media varies in size from about 23 centimeters wide and 23 centimeters long to about 82 centimeters wide and about 114 centimeters long. In another embodiment the area of the media varies from about 520 square centimeters to about 9,350 square centimeters. Transporter 100 is adapted to transport media which is in a landscape orientation, i.e. wider than it is long, such as media 200 and media 202. Transporter 100 is also adapted to transport portrait media, i.e. longer than it is wide, such as media 201.

Figure 3:
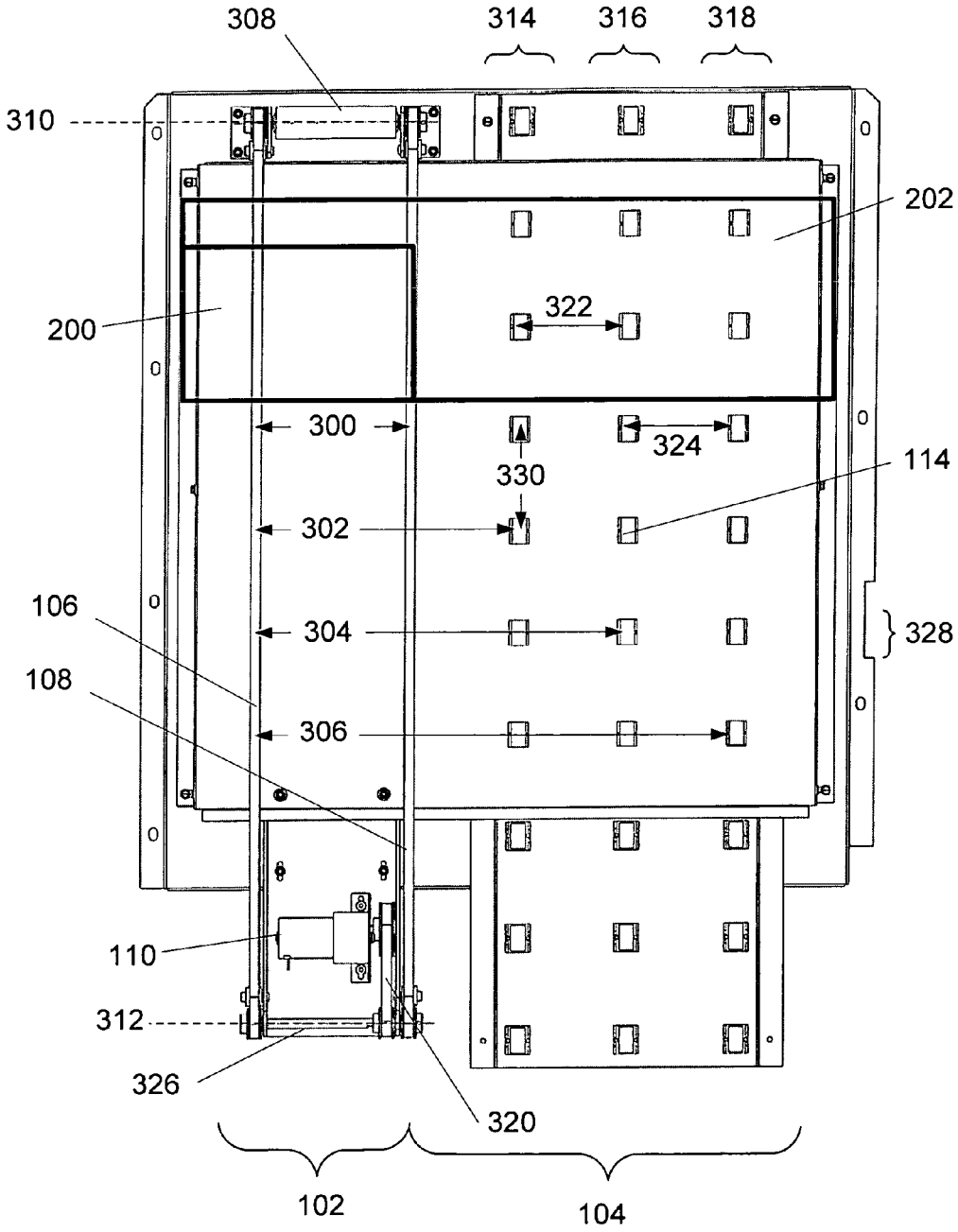
FIG. 3 is a detailed top view of the transportation apparatus of FIG. 2.

FIG. 3 is a detailed top view of the transporter 100 depicted in FIG. 2A. In the embodiment depicted in FIG. 3, first timing belt 106 and second timing belt 108 (see FIG. 1) are separated by belt distance 300. In one embodiment, belt distance 300 is from about 8 centimeters to about 45 centimeters. In another embodiment, distance 300 is about 15 centimeters. Such a belt distance permits the transporter 100 to accommodate media with a width as small as the aforementioned belt distance, without utilizing supporting section 104. Media which is substantially wider than belt distance 300 will come into contact with supporting section 104 and be supported by rollers 114 (see FIG. 1). In the embodiment depicted, such rollers are organized into a series of rows.

Figure 3A:
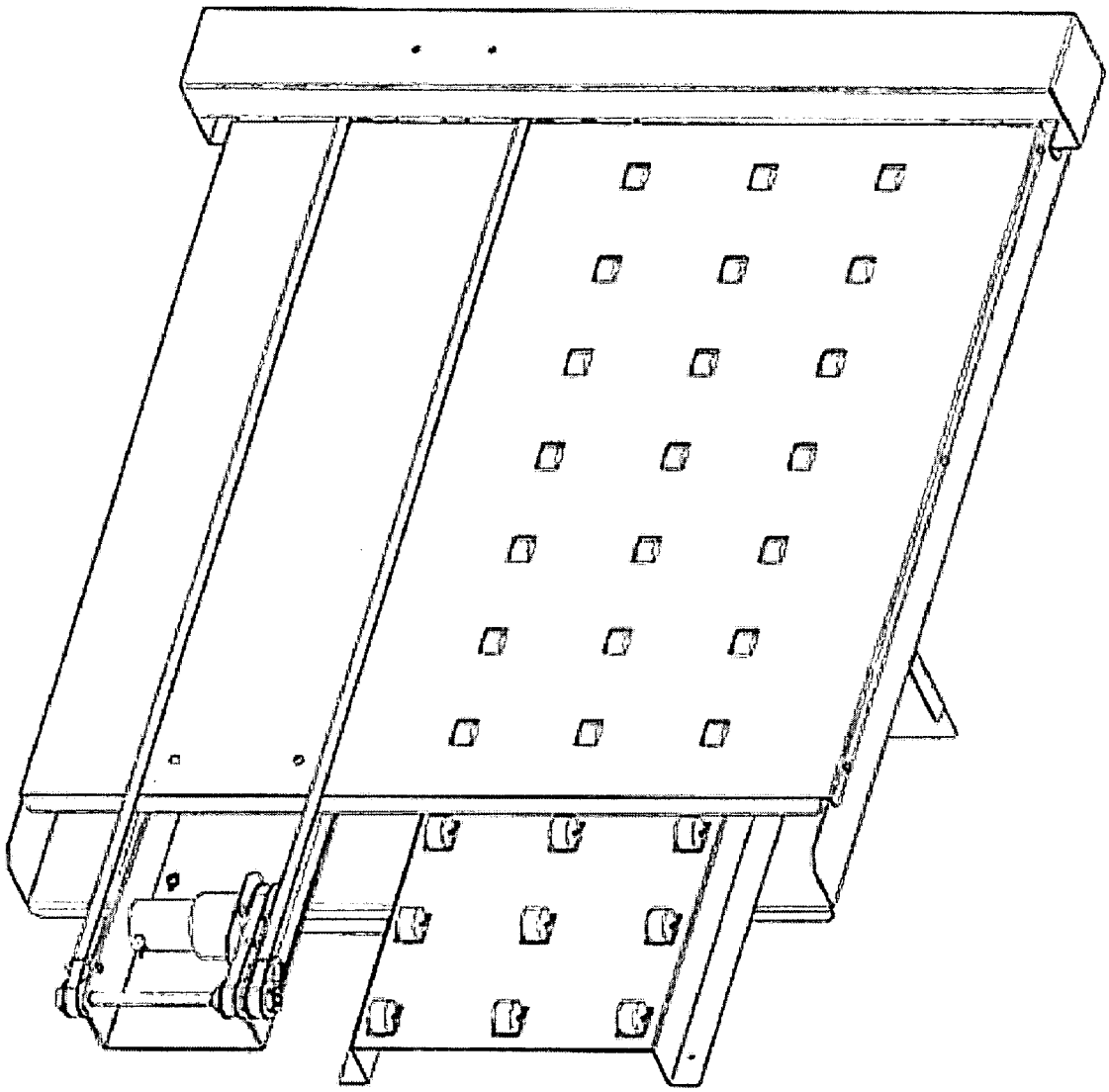
FIGS. 3A, 3B, 3C and 3D are perspective and top views of other embodiments of the invention.
Figure 3B:
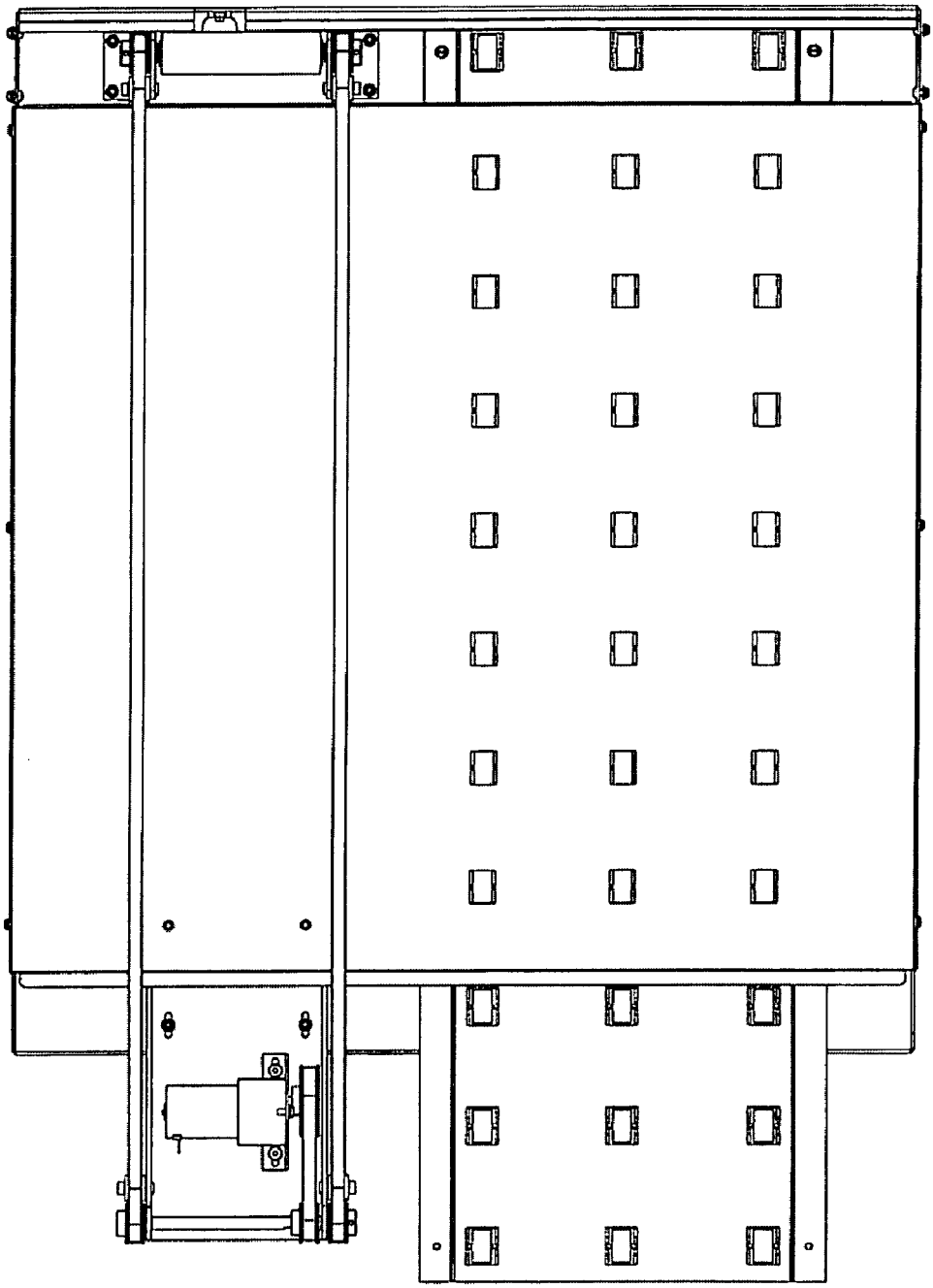
Figure 3C:
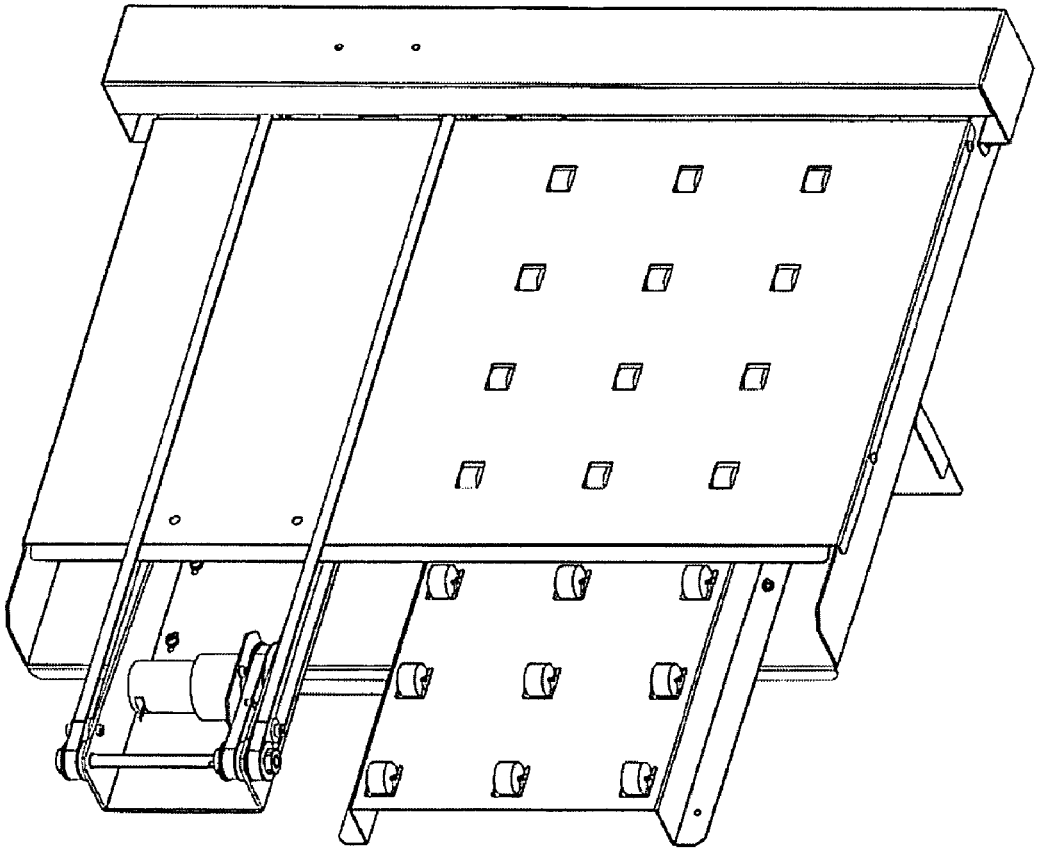
Figure 3D:
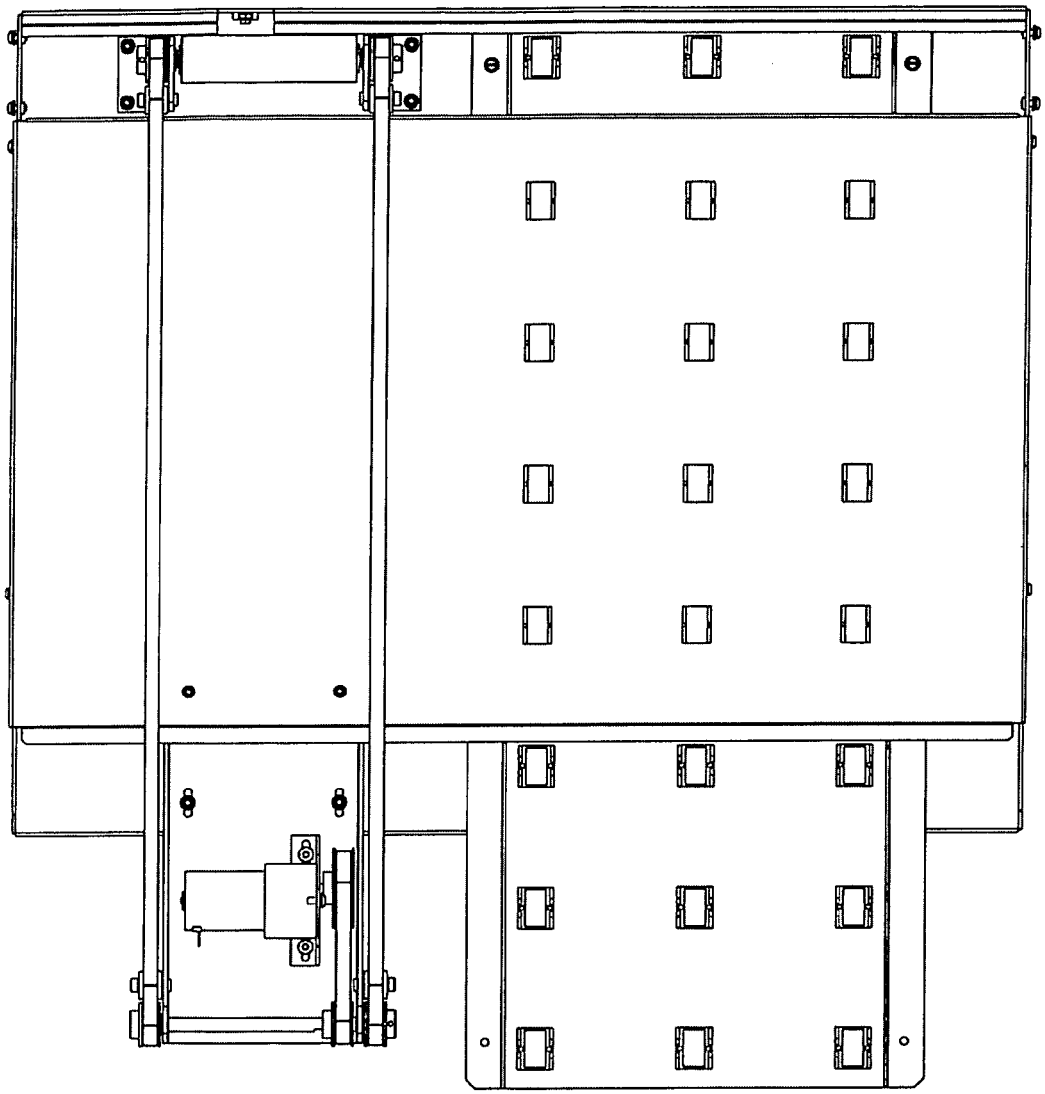

As can be seen in FIG. 3, supporting section 104 is comprised of rollers 114 which are arranged in first row 314, second row 316, and third row 318. In another embodiment, not shown, a fourth row is present. In the embodiment depicted, three such rows are used. The use of a different number of rows is also contemplated for use with the present invention. As would be apparent to one skilled in the art, additional rows allow the transporter 100 to accommodate wider media, such as large media 202. To accommodate such larger media, the rows are arranged such that they are sequentially more distal relative to timing belts 106 and 108. For example, and with reference to FIG. 3, first row 314 is a first distance 302 away from first timing belt 106 and second row 316 of rollers 114 are a second distance 304 away from first timing belt 106, wherein the second distance 304 is greater than the first distance 302. In the embodiment depicted, a third row 318 is employed. Such a third row is optional. In such an embodiment, third row 318 of said rollers is a third distance 306 away from first timing belt 106, wherein third distance 306 is greater than second distance 304. In one embodiment, first distance 302 is from about 15 centimeters to about 35 centimeters, second distance 304 is from about 26 centimeters to about 46 centimeters, and third distance 306 is from about 37 centimeters to about 57 centimeters. In one embodiment, first distance 302 is about 26 centimeters, second distance 304 is about 36 centimeters, and third distance 306 is about 47 centimeters. In the embodiment depicted in FIG. 3, the rollers are evenly spaced such that the gap 322 between first row 314 and second row 316 is substantially equal to the gap 324 between second row 316 and third row 318. In other embodiments, not shown, gap 322 and gap 324 are not equal to one another, and the rows are unevenly spaced. In the embodiment depicted, the rollers 114 are organized into columns, such as column 328. In other embodiments, not shown, the rollers are not organized into columns, but instead, are in a staggered configuration. The rollers are spaced such that the media will not droop and contact cover 116. In one embodiment, the rollers within a given row are evenly spaced such that a gap 330 of about 10 centimeters exists between each roller. In the embodiment depicted in FIG. 3, ten such columns 328 are present. In another embodiment, additional columns are present, thus allowing for larger media to be accommodated. Reference may be had to FIG. 3A and FIG. 3B. Additional columns 328 may be inserted by ordinary means. For example, one may expand the length of transporter 100. Alternatively or additionally, one may reduce the gap 330 between rollers in adjacent columns 328, thus allowing for more columns. In one embodiment, gap 330 is from about 9 centimeters to about 10 centimeters. Similarly, fewer than ten columns may be used. Reference may be had to FIG. 3C and FIG. 3D. Such embodiments are advantageous in that the overall size of the transporter is reduced.

Figure 4:
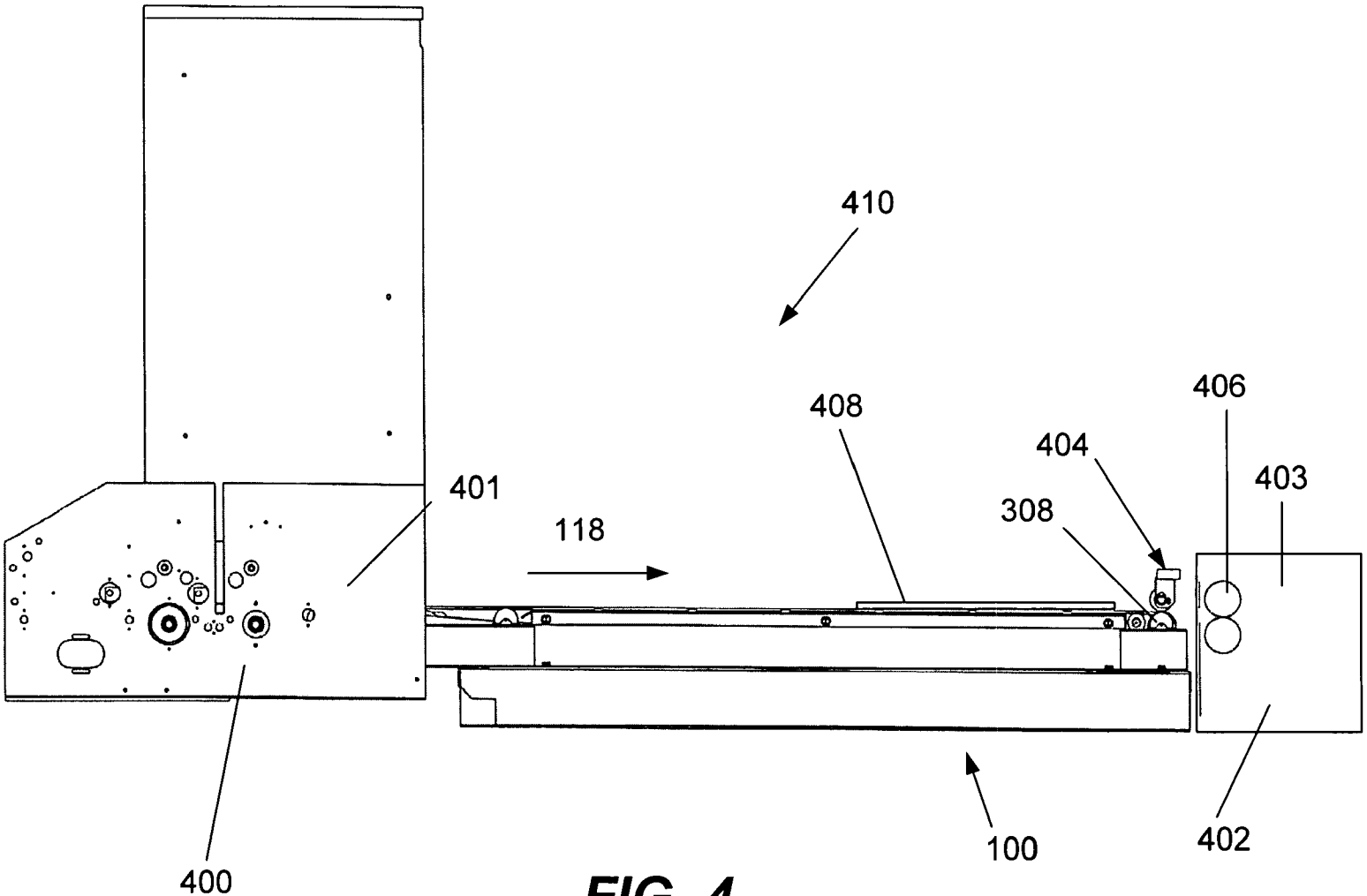
FIG. 4 is a schematic diagram of one assembly of the present invention.

Referring again to FIG. 3, and in the embodiment depicted therein, timing belts 106 and 108 (see FIG. 1) are endless timing belts that rotate about a first and second axis. As is apparent to one skilled in the art, such endless timing belts rotate about a first axis of rotation 310 and about a second axis of rotation 312. The second axis of rotation 312 is the axis of rotation of shaft 326. Shaft 326 is operatively connected to motor 110 via drive belt 320 such that operation of motor 110 causes drive belt 320 to rotate, thus actuating shaft 326. The rotation of shaft 326, in turn, causes first and second timing belts 106 and 108 to translate in first direction 118 (see FIG. 1). The first axis of rotation 310 is the axis of rotation of drive force enhancer 308. In one embodiment, drive force enhancer 308 is a nip roller. In another embodiment, drive force enhancer 308 is a vacuum belt. Other suitable drive force enhancers would be apparent to one skilled in the art, and are contemplated for use with the present invention. In one embodiment, drive force enhancer 308 rotates independently of first and second timing belts 106 and 108 and is driven by a second motor (not shown). In the embodiment depicted in FIG. 3, drive force enhancer 308 is disposed between first timing belt 106 and second timing belt 108. When such a drive force enhancer 308 is mated with a pressure roller (not shown in FIG. 3, but see FIG. 4), such a configuration allows media, such as small media 200, to be grasped between drive force enhancer 308 and the pressure roller. In this manner, the media is transferred to another device, such as a processing device. It is advantageous that, in one embodiment, drive force enhancer 308 be a high friction nip roller. In one embodiment, such a nip roller 308 is covered with a high friction rubber. For example, in one embodiment the nip roller is coated with urethane. Such a rubber nip roller promotes the gripping action of the nip roller and pressure roller, and thus promotes the removal of the media from transporter 100. In one embodiment, the nip roller has a length substantially equal to belt distance 300. Once the media has been firmly engaged by the drive force enhancer, the media is forcefully presented to receiving rollers 406, as shown in FIG. 4. Drive force enhancer 308 presents the media to receiving rollers 406 with a force greater than first and second belts 106 and 108 could provide. Such a drive force enhancer configuration promotes the transfer of media from an imaging device to a processing device.

FIG. 4 is a schematic diagram that depicts the transfer of media from first location within an imaging device to a second location within a processing device. In FIG. 4, assembly 410 is comprised of Computer-to-Plate (CTP) device 400, transporter 100, and processing device 402. Also illustrated in FIG. 4 is first location 401, disposed within CTP device 400, second location 403, disposed within processing device 402, pressure roller 404, and media 408. Numerous CTP devices are known to those skilled in the art. Reference may be had to U.S. Pat. No. 6,684,783 to Salvestro (Method for imaging a media sleeve on a computer-to-plate imaging machine); U.S. Pat. Nos. 6,662,723; 6,526,886; 6,523,473; 6,523,472; 6,457,413; all to Loccufier (Computer-to-plate by ink jet); U.S. Pat. Nos. 5,992,324 and 5,738,014; both to Rombult (Method and apparatus for making lithographic printing plates in an automated computer to plate imaging system); and the like. Similarly, many processing devices are also known. For example, one may use a Glunz & Jensen Raptor 68, a Raptor 85 processor, an Interplater 85HD processor, an Interplater 135HD processor, an AGFA LP82 processor, a Colenta ILP 68 processor, and the like.

In one process of the invention, CTP device 400 presents the media 408 to the transporter 100 at an imaging speed at first location 401. Thereafter, transporter 100 accepts media 408 onto the belt surface of belts 106 and 108 (see FIG. 1) which are traveling at a belt speed. Due to the time required to image such a plate, such imaging speeds of CTP device 400 are typically slow. In one embodiment, the imaging speed is slower than the belt speed of transporter 100. Once the media has been transferred to transporter 100, the media thereafter travels in direction 118, from first location 401 of CTP device 400 to the second location 403 of processing device 402 by the action of transporter 100. In the embodiment depicted, media 408 is grasped by drive force enhancer 308 and pressure roller 404. Such a grasping action controls media 408 such that it is transferred to receiving rollers 406 of processing device 402 in a controlled fashion. Such control is desirable so as to ensure proper entry of the media into the receiving rollers 406. Thereafter, the media is transferred to second location 403.

The non-toothed surface of timing belts 106 and 108 provides a relatively low friction surface such that the media remains on the belts without slipping, but the friction is not so high that the belts prematurely withdraws the media from CTP device 400. Similarly, the relatively low friction surface of timing belt 106 and 108 does not substantially resist the pulling action of drive force enhancer 308 and pressure roller 404. In one embodiment, drive force enhancer 308 is comprised of a clutch bearing 500 (see FIG. 5) that permits drive force enhancer 308 to be disengaged and rotate freely. Such a disengagement permits the removal of media from the apparatus at speeds greater than the drive force enhancer speed. The clutch permits drive force enhancer 308 to rotate freely in a first rotary direction at any speed.

Figure 5:
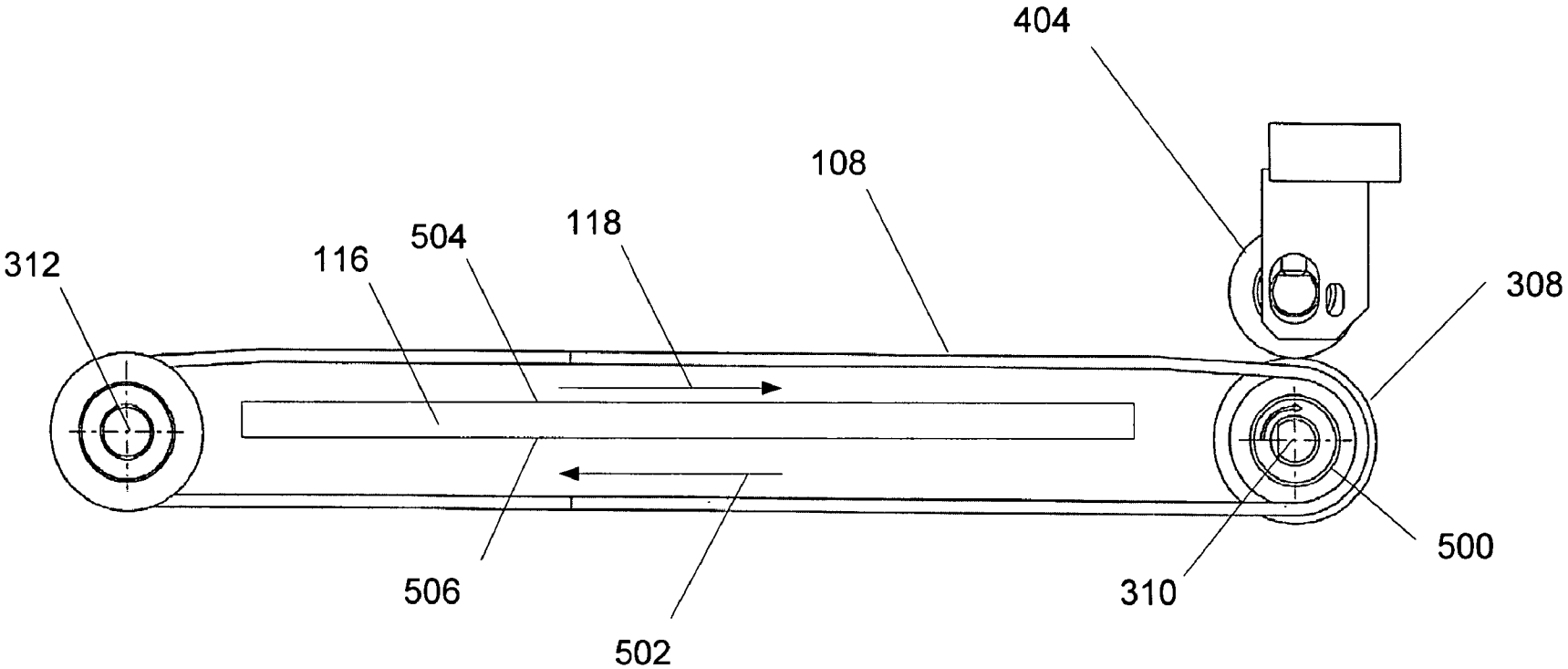
FIG. 5 is a detailed illustration of one configuration of a nip and pressure roller of the invention.

FIG. 5 is a detailed illustration of drive force enhancer 308 and pressure roller 404. In the embodiment depicted, drive force enhancer 308 is comprised of a clutch bearing 500. Second timing belt 108 travels about the first axis of rotation 310 (see FIG. 3) in first direction 118. After looping about first axis of rotation 310, the timing belt 108 travels in second direction 502. Second direction 502 is opposite first direction 118. In this manner, the timing belt 108 passes over top side 504 of cover 116, around the first axis of rotation 310 (see FIG. 3) and under bottom side 506 of cover 116.

Clutch bearing 500 permits the drive force enhancer 308 to rotate at a speed other than the speed of the second timing belt 108. In this manner, the imaging speed of the imager, the belt speed of the transporter and the processing speed of the processor need not be synchronized. In one embodiment, first and second timing belts 106 and 108 are traveling at a belt speed and the drive force enhancer 308 and pressure roller 404 are rotating at a drive force enhancer speed, wherein the drive force enhancer speed is greater than the belt speed. For example, in one embodiment, the belt speed is from about 9 centimeters per minute to about 200 centimeters per minute and the drive force enhancer is greater than such belt speed. In one embodiment, the drive force enhancer speed varies from about 9 centimeters per minute to about 200 centimeters per minute. In one embodiment, the drive force enhancer speed varies such that it may travel as slowly as the belt speed or as quickly as the processor speed. The speed of the drive force enhancer is determined by measuring the amount of time necessary to move a plate with a certain length from one side of the enhancer to the other side of the enhancer. For example, if a media were 5 centimeters long and it took the drive force enhancer 0.05 minutes to move such media through the enhancer, then such an enhancer would be operating at a drive force enhancer speed of 100 centimeters per minute.

The present invention permits the CTP device 400 to operate at an imaging speed, the processor device 402 to operate at a processing speed, and the transporter 100 to operate at a belt speed, wherein the aforementioned speeds are not necessarily equal. As would be apparent to one skilled in the art, the imaging speed of CTP devices 400 depends upon the resolution of the plate being produced. For example, higher resolution plates require greater imaging times, thus the imaging speed is relatively slow. In one embodiment of the invention, transporter 100 is operating at a belt speed that is greater than the imaging speed of CTP device 400. Likewise, the processing speed of processor device 402 is not necessarily equal to the belt speed of transporter 100. In one embodiment, the processing speed is greater than the belt speed. For example, in one embodiment, as the plate is being presented by CTP device 400 to transporter 100 at an imaging speed which is less than the belt speed, the low friction surface of the timing belts will not pull the media from device 400 until such time as device 400 releases the plate. Once released, the media moves at the belt speed toward processor device 402 and presents the media to drive force enhancer 308. Drive force enhancer 308 grips the media and forcefully presents it to processor device 402, thus proactively pushing the media into receiving rollers 406. As would be know by those skilled in the art, devices such as processor device 402 typically require the media be partially disposed between the receiving rollers 406 by applying substantial force to the media. Once the media is partially disposed between receiving rollers 406, the rotation of such rollers pulls the media into the processor device 402. Nevertheless, an applied force is often needed so as to place the media in a position where the receiving rollers 406 can engage the media. Drive force enhancer 308 provides such a force. In the embodiment depicted, drive force enhancer 308 is a nip roller. As would be apparent to one skilled in the art, other suitable drive force enhancers may be used in place of a nip roller. Such alternative drive force enhancers are considered within the scope of this invention.

Once the receiving rollers 406 have engaged the media, the media is moving at a processing speed. In one embodiment, the processing speed is greater than the belt speed. In such an embodiment, clutch bearing 500 allows the drive force enhancer to rotate at a speed other than the belt speed (i.e. at the processing speed). Thus, the one-way clutch bearing 500 releases the media to processor device 402 without resisting the pull of receiving rollers 406.

It is therefore, apparent that there has been provided, in accordance with the present invention, a method and apparatus for transporting media from a first location to a second location. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A media transportation apparatus comprising: (a) a conveying section comprised of a motor and a first timing belt wit a belt surface, wherein operation of said motor causes said first timing belt to travel in a first direction at a belt speed, and (b) a supporting section comprised of rollers with a rolling surface configured to roll in said first direction, wherein said supporting section is further comprised of a cover with a top side and a bottom side, said cover being comprised of a plurality of orifices such that said rollers protrude through said orifices and said rolling surface of said rollers is raised above said top side of said cover by a distance of at least about 1 millimeter, wherein said first timing belt passes over said top side of said cover and said bottom side of said cover, wherein:

1. said belt surface and said rolling surface are substantially coplanar,
2. said supporting section is comprised of a first row of said rollers that arc a first distance away from said first timing belt wherein said apparatus is comprised of a second timing belt and wherein said first timing belt and said second timing belt passes over said top side of said cover and said bottom side of said cover, and
3. said supporting section is further comprised of a second row of said rollers that are a second distance away from said first timing belt, wherein said second distance is greater than said first distance.

2. The media transportation apparatus as recited in claim 1, wherein said supporting section is further comprised of a third row of said rollers that are a third distance away from said first timing belt, wherein said third distance is greater than said second distance.

3. The media transportation apparatus as recited in claim 2, wherein said first distance is from about 15 centimeters to about 35 centimeters, said second distance is from about 26 centimeters to about 46 centimeters, and said third distance is from about 37 centimeters to about 57 centimeters.

4. The media transportation apparatus as recited in claim 3, wherein said first row is parallel to said second row and said second row is parallel to said third row.

5. The media transportation apparatus as recited in claim 4, wherein said first belt is a toothed belt.

6. The media transportation apparatus as recited in claim 1, wherein:

(a) said supporting section is further comprised of a third row of said rollers that are a third distance away from said first timing belt, wherein said third distance is greater than said second distance;

(b) said first distance is from about 15 centimeters to about 35 centimeters, said second distance is from about 26 centimeters to about 46 centimeters, and said third distance is from about 37 centimeters to about 57 centimeters;

(c) said first row is parallel to said second row and said second row is parallel to said third row; and (d) said conveying section is further comprised of a second timing belt which is substantially parallel to said first timing belt, wherein operation of said motor causes said second timing belt to travel in said first direction at said belt speed.

7. The media transportation apparatus as recited in claim 6, wherein said belt speed is controlled by said motor such that said belt speed is from about 9 centimeters per minute to about 200 centimeters per minute.

8. The media transportation apparatus as recited in claim 7, wherein said first timing belt and said second timing bolt are separated by a distance of from about 8 centimeters to about 45 centimeters and wherein said first timing belt and said second timing belt have a width of from about 0.25 centimeters to about 15 centimeters.

9. The media transportation apparatus as recited in claim 8, further comprising a drive force enhancer, wherein said drive force enhancer is disposed between said first timing belt and said second timing belt.

10. The media transportation apparatus as recited in claim 9, wherein said drive force enhancer is a nip roller with a length of from about 5 centimeters to about 42 centimeters.

11. The media transportation apparatus as recited in claim 10, wherein said drive force enhancer is further comprised of a clutch that permits said drive force enhancer to rotate freely in a first rotary direction.

12. The media transportation apparatus as recited in claim 11, further comprising a pressure roller wherein said pressure roller is contiguous with said drive force enhancer.

13. The media transportation apparatus as recited in claim 1, further comprising a computer-to-plate imaging device, wherein said imaging device is configured so as to deposit a media at a first location on said transportation apparatus.

14. The media transportation apparatus as recited in claim 13, further comprising a processing device for processing said media, wherein said processing device is configured to receive said media from said transporter.

15. The media transportation apparatus as recited in claim 1, wherein:

(a) said first distance is from about 15 centimeters to about 35 centimeters, and said second distance is from about 26 centimeters to about 46 centimeters;

(b) said first row is parallel to said second row;

(c) said conveying section is further comprised of a second timing belt which is substantially parallel to said first timing belt, wherein operation of said motor causes said second timing belt to travel in said first direction at said belt speed;

(d) said conveying section further comprises a drive force enhancer;

(e) wherein said drive force enhancer is further comprised of a clutch;

(f) said conveying section further comprises a pressure roller wherein said pressure roller is contiguous with said drive force enhancer;

(g) said media transportation apparatus is further comprised of a computer-to-plate imaging device, wherein said imaging device is configured so as to deposit a media at a first location on said transportation apparatus; and (h) said media transportation apparatus is further comprised of a processing device for processing said media, wherein said processing device is configured to receive said media from said transporter wherein said computer-to-plate imaging device is operating at an imaging speed wherein said imaging speed is less than said belt speed; and said processing device is operating at a processor speed, wherein said processing speed is greater than said belt speed.

16. The media transportation apparatus as recited in claim 15, wherein said processing device is comprised of receiving rollers operating at said processing speed and wherein, when said media is disposed between said receiving rollers, said clutch disengages said drive force enhancer such that said drive force enhancer operates at a speed greater than said drive force enhancer speed, thereby permitting the remove of said media from said drive force enhancer at said processing speed.

* * * * *